United States Patent [19]

Engelhart

[11] Patent Number: 4,741,241

[45] Date of Patent: May 3, 1988

[54] PERCUSSION MUSICAL INSTRUMENT

[76] Inventor: Peter B. Engelhart, 2815 Cherry St., Berkeley, Calif. 94705

[21] Appl. No.: 8,845

[22] Filed: Jan. 30, 1987

[51] Int. Cl.[4] ..... G10D 13/06

[52] U.S. Cl. ..... 84/403; 84/418

[58] Field of Search ..... 84/402–410, 84/418

[56] References Cited

U.S. PATENT DOCUMENTS

| | | | |
|---|---|---|---|
| 1,567,803 | 12/1925 | Ludwig | 84/402 |
| 2,504,457 | 4/1950 | Rundell | 84/404 |
| 2,862,412 | 12/1958 | Kreizel | 84/403 |
| 4,075,922 | 2/1978 | Smith | 84/402 |
| 4,269,105 | 5/1981 | Salmon | 84/402 |

FOREIGN PATENT DOCUMENTS

| | | | |
|---|---|---|---|
| 2317705 | 10/1974 | Fed. Rep. of Germany | 84/403 |

*Primary Examiner*—Lawrence R. Franklin

*Attorney, Agent, or Firm*—Thomas M. Freiburger

[57] ABSTRACT

A percussion musical instrument produces a "crashing" sound using a series of stacked metal strips or leaves of a specific configuration. The leaves are relatively thin, upwardly arched or bowed, arranged in alternating criss-cross configuration, and each includes a twist about a generally longitudinal axis. The twist in each leaf is in an opposite direction to the twist in the adjacent leaf or leaves. A base supports the stack of ribbons loosely, so that when the stack is struck downwardly and centrally, a decided sound of relatively long sustain will be produced.

12 Claims, 2 Drawing Sheets

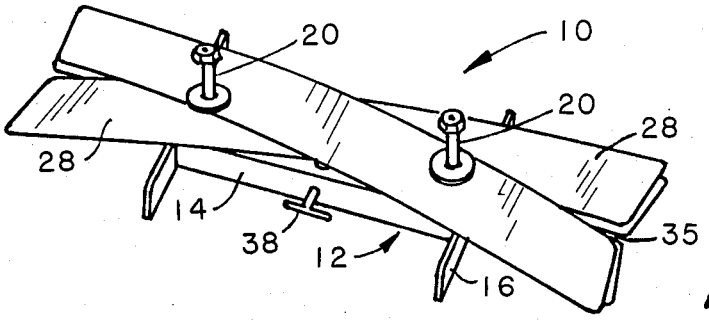
FIG._1
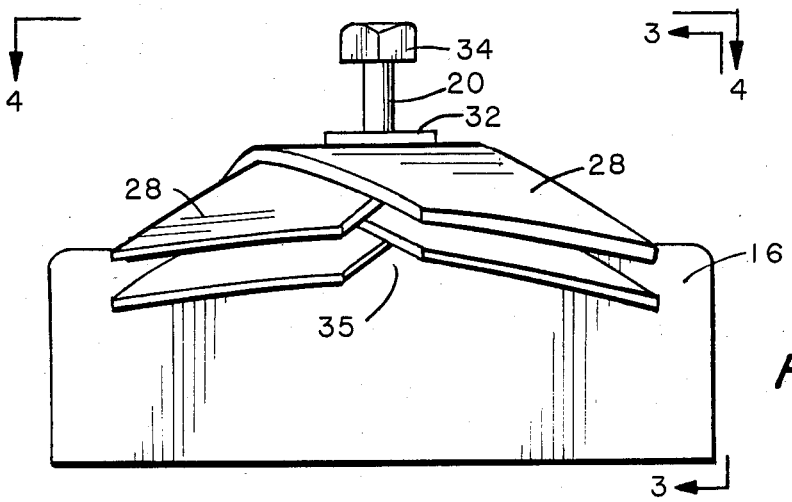
FIG._2
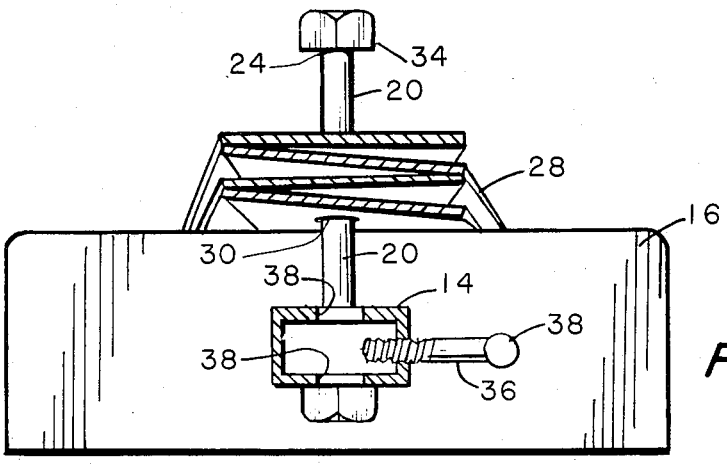
FIG._5
FIG._6
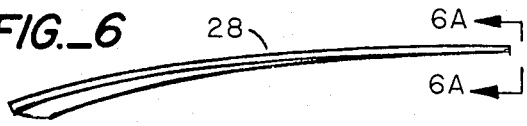
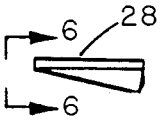
FIG._6A
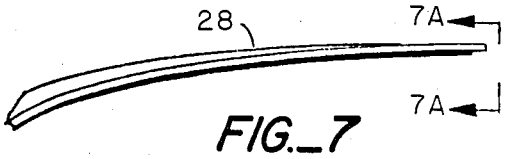
FIG._7
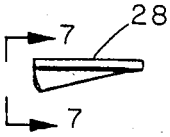
FIG._7A

PERCUSSION MUSICAL INSTRUMENT

BACKGROUND OF THE INVENTION

The invention relates to the art of musical instruments, particularly instruments played by shaking, or by striking the instrument, or a specific part of the instrument, with a hand stick, hammer, or the like. More specifically, this invention relates to a percussion instrument comprising several loosely joined layers of metal strips which produce a "crashing" sound when shaken or struck by a musician.

Instruments of this type have in the past comprised metal strips which have directly overlaped each other in a uniform fashion. Such construction generally results in each strip being in substantially full contact with the strip above and below. Sustain and amplitude of vibrations produced by a metal strip are inhibited by contact of the strip with adjacent strips, and therefore the full overlap and extended contact of adjacent strips in previous such instruments diminished the dynamics of the instruments.

The prior art discloses no attempt at improving dynamics of such an instrument by reducing contact and overlap of the resonant members. Instead, the metal strips have been in uniform order and in full contact with adjacent strips.

SUMMARY OF THE INVENTION

Therefore, it is among the objects of this invention to create a percussion instrument with an improved sound derived from greater sustain and amplitude of vibrations produced by a stack of ribbon strips. According to the present invention this improvement is achieved by alternately crossing the ribbon strips to expose a greater portion of each strip and by minimizing the contact between the remaining overlapped portions of the strips through slightly twisting each strip about its length, or longitudinal axis. The greater gaps between adjacent ribbon strips reduces contact between adjacent strips and minimizes the damping effect each strip has on adjacent strips as in previous instruments. A greater "crashing" sound results from striking the instrument of the present invention.

DESCRIPTION OF THE DRAWINGS

FIG. 1 is a perspective view showing a percussion musical instrument in accordance with the present invention.

FIG. 2 is an end view of the instrument, as seen generally along the line 2—2 in FIG. 3.

FIG. 5 is an elevational sectional view of the instrument, as seen generally along the line 5—5 in FIG. 4.

FIG. 6 is a side elevation view showing a portion of one strip or leaf of the musical instrument of the invention, illustrating the twist of each leaf about its generally longitudinal axis. FIG. 6A is a sectional view as seen along the line 6A—6A in FIG. 6, again illustrating the twist of the leaf.

FIGS. 7 and 7A are similar to FIGS. 6 and 6A, but illustrating the reverse twist of a leaf positioned immediately underneath the leaf shown in FIGS. 6 and 6A.

DESCRIPTION OF PREFERRED EMBODIMENT

Figure 3:
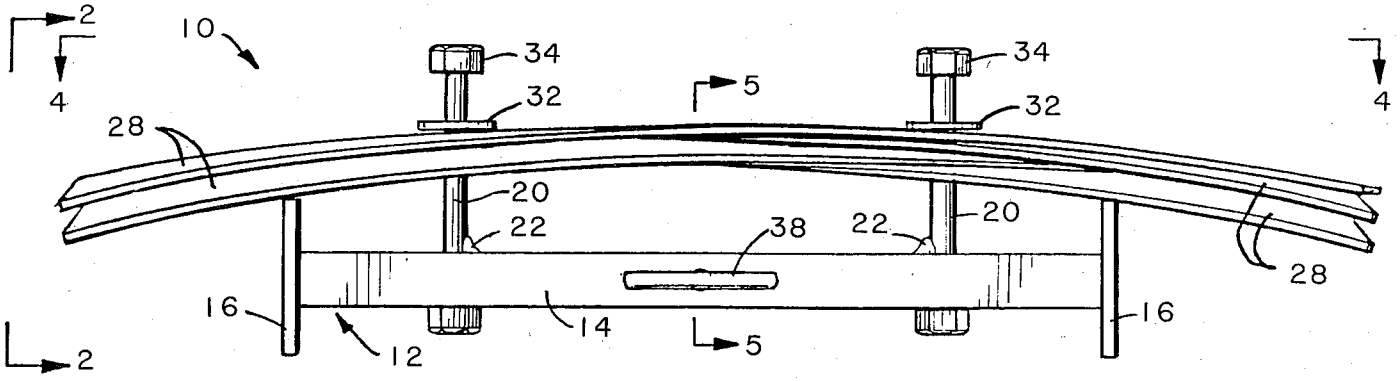
FIG. 3 is a side elevation view of the instrument.

The drawings show a percussion musical instrument according to the invention, indicated generally by the reference numeral 10. The instrument 10 is played by striking downwardly approximately at its center, using a striking stick or the heel of one's hand. This produces a "crashing" metallic sound with some sustain.

As shown in FIG. 1, the instrument has a base 12 which comprises a generally rectangular horizontal bar 14 interposed between two generally rectangular end plates 16 disposed in vertical planes, serving as feet supporting the horizontal bar above a surface upon which the base may rest.

Two posts 20, spaced equidistant from the center point of the horizontal bar's top surface and extending vertically from the bar 14, rise to a height several inches above the top surface of the bar. The posts are fixedly secured to the bar 14 in the preferred embodiment by means of a weld 22, as shown in FIG. 3. Although the posts may be secured by other means, use of a weld insures the posts will not become dislodged due to hard blows to the instrument while being played. The posts may be provided with machine threads 24 at their upper ends.

As shown in FIGS. 1 and 2, the instrument of the invention further comprises a stack of thin, bowed metal leaves or strips 28, preferably of a generally trapezoidal shape. These somewhat flexible strips provide the desired sound produced by the instrument, and their configuration and the manner in which they rest on each other in the stack are important features in determining the sound and degree of sustain produced by the instrument.

In the preferred embodiment, the strips 28 are of about 18 to 20 (preferably 20 ) gauge steel. They should be high tensile strength, high carbon steel, and may be 1050 spring steel, for example. The strips, when of this thickness and about 13 inches in length and $1\frac{1}{2}$ to $1\frac{3}{4}$ inches in width, have an upward arch or bow of approximately $\frac{3}{4}$ inch, as measured from the level of the ends up to the middle. These design parameters result in a resilient strip with desirable resonant qualities.

Each strip 28 has two holes 30 spaced generally equidistant from the center of the ribbon strip, and each being about the same distance from the adjacent post, as illustrated in the drawings. The holes are of a greater diameter than the posts, so that the strips fit loosely on the posts.

Figure 4:
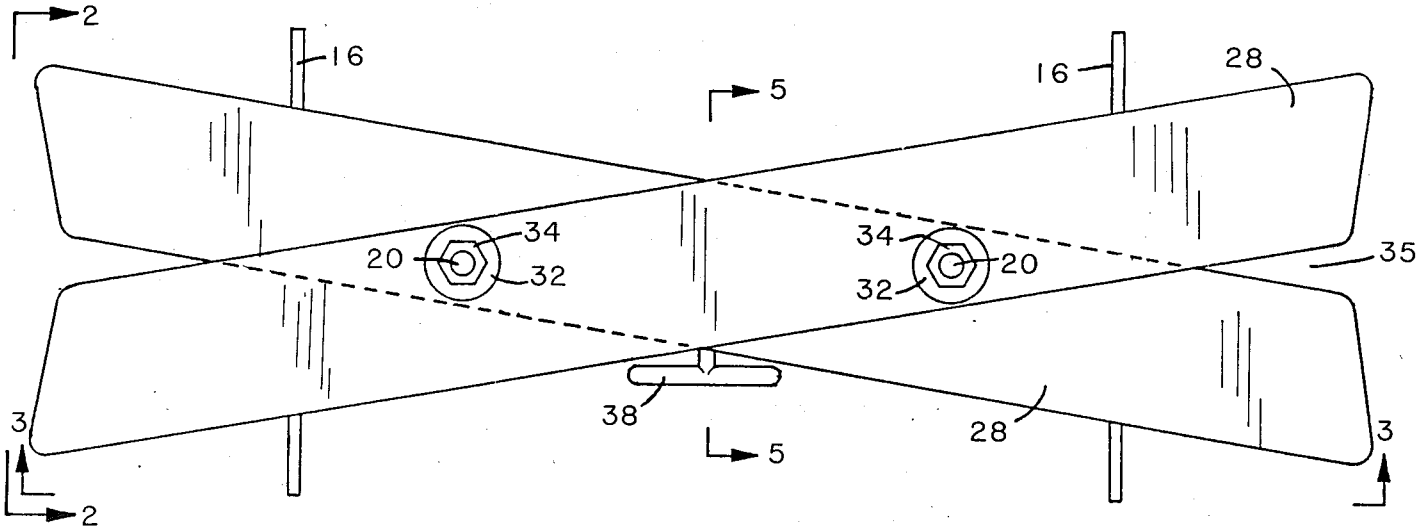
FIG. 4 is a top plan view of the instrument.

As seen in FIGS. 1 and 4, each hole is located closer to one side of the strip than the other. The holes and posts are so positioned that when a strip is lowered over the base 12, with the posts 20 extending through the holes 30, the strip 28 will be oriented obliquely with respect to the bar 14, with the length or horizontal axis of the strip intersecting and crossing over the bar 14 near the midpoint of both the bar 14 and strip 28. Alternate strips 28 are obliquely angled in opposite directions, as shown in the drawings, at approximately equal angles. The holes in alternate strips are located to effect this criss-crossed or X-shaped configuration.

As shown in the drawings, each retaining post 20 may have placed over it a washer 32 and a nut 34, screwed onto the post threads 24 so that the resonant strips 28 are loosely retained on the posts.

The manner in which the metal leaves or strips 28 are supported on the base is important. Preferably, the supports 16 are linear and horizontal as shown, spaced outwardly from the posts 20 and inwardly from each end of the leaves by a distance equal to about 20 percent to 30 percent of the length of the leaf.

As illustrated in FIGS. 1, 2 and 4, the metal leaves may be crossed at a sharp enough angle that a transverse gap 35 occurs between the edges of adjacent leaves 28 at their ends. The leaves may be generally parallelogram shaped in plan view, giving the general appearance of a ribbon or bow tie.

As shown by FIGS. 1, 2 and 4, the crossing pattern of the strips results in a greater portion of each ribbon strip being exposed and not nested with an adjacent strip or strips. Therefore, less overlap or direct contact occurs between strips.

In addition, as shown particularly in FIGS. 2, 3 and 5 through 8A, each strip is also twisted slightly about its generally longitudinal axis, and the direction of such twisting alternates with each successive strip. Contact between adjacent strips is thereby reduced to a limited number of points. See particularly FIGS. 6 and 6A, 7 and 7A.

The effect of this reduction in overlap in contact is to minimize the damping effect each strip has upon the other, allowing the strip to more easily and freely vibrate against an adjacent strip(s). Also, the spacing between successive strips, coupled with the flexible nature of the bowed strips and the loose fit of the strips about the posts, causes a greater "crashing" of the strips upon one another than is possible with previous conventional arrangements. Thus, increase in sustain and amplitude of vibrations emanating from the ribbon strips is achieved.

The percussion musical instrument 10 of the invention may be used on a table top or other surface, or it may be secured to the upwardly extending rod of a stand (not shown). For the use on a stand, the horizontal bar 14 of the instrument includes a set screw 36 which is threaded into the bar 14 adjacent to a bore 38 through the bar. Thus, the set screw 36 may be tightened against a vertical rod placed through the bore 38, as best illustrated in FIG. 5.

When the instrument 10 is struck sharply by a hand or stick, downwardly on the top resonant ribbon strip or leaf 28 between the posts 20, a relatively loud metallic "Tshhhh!" sound is produced, somewhat like the sound of a tambourine. In general, it has been found that a longer sustain is produced with fewer leaves, and a quicker sound is produced with more leaves. Four leaves 28 are shown in this preferred embodiment, and with this embodiment, with preferred features as set forth above, a maximum sustain of over one second can be produced. Heavier leaves produce lower sounds.

The above described preferred embodiment is intended to illustrate the principles of the invention, but not to limit its scope. Other embodiments and variations to this preferred embodiment will be apparent to those skilled in the art and may be made without departing from the scope of the invention as defined in the following claims.

I claim:

1. A percussion musical instrument comprising:

a base, including two generally parallel spaced apart transverse support members, a pair of posts attached to and rising vertically from the base, a plurality of relatively thin-gauge, elongated bowed metal leaves or strips having oversized holes located for registry with the vertical posts, the leaves being stacked on the base bowed upwardly with the center of each leaf higher than its ends and the two transverse support members supporting the stack and with the posts extending through the holes, and the holes in the leaves being so located that each leaf lies obliquely across the length of the base and such that alternate leaves cross the base in opposite oblique directions, so that the alternate leaves in the stack form generally an X-configuration, whereby, when the instrument is struck with a sharp downward blow generally centrally, a metallic sound of relatively long sustain is produced.

2. The instrument of claim 1, wherein the base comprises a generally rectangular horizontal bar to which the vertical posts are secured, and two generally vertical plates fixedly secured perpendicularly to the opposite ends of the horizontal bar so that when sitting on a flat surface the base rests upon bottom edge surfaces of the end plates and the horizontal bar is elevated above said surface, the plates having upper edges forming said spaced apart transverse support members.

3. The instrument of claim 1, wherein the bowed metal leaves each have a slight twist about a generally longitudinal axis of the leaf, and wherein the direction of twist alternates between successive leaves, whereby the contact between adjacent leaves is minimal.

4. The instrument of claim 1, whereby the bowed ribbon strips are of 18 to 20 metal.

5. The instrument of claim 1, further including nuts screwed out the upper ends of the posts, at a height substantially above the uppermost leaf, for preventing escape of the leaves off the posts while permitting freedom of the leaves to bounce upwardly when struck.

6. The instrument of claim 1, wherein the leaves are about 13 inches long and are upwardly bowed about $\frac{3}{4}$ inch at their center.

7. The instrument of claim 1, wherein the width of each leaf is about $1\frac{1}{2}$ inch to $1\frac{3}{4}$ inch.

8. The instrument of claim 1, wherein the transverse support members are positioned inward from the ends of the leaves a distance about 20 percent to 30 percent of the length of the leaves.

9. The instrument of claim 1, further including set screw means on the base for securing the base to a stand.

10. The instrument of claim 1, wherein the leaves are each of general parallelogram shape.

11. The instrument of claim 1, wherein each bowed metal leaf has a slight twist about its length, with alternate leaves having opposite directions of twist, so that contact between adjacent leaves is minimized, and wherein the thickness of the leaves is about 20 gauge.

12. The instrument of claim 1, wherein the oblique angling of alternate metal leaves is sufficient to form a gap between adjacent metal leaves transversely at their ends.

* * * * *